US005123471A

United States Patent [19]

Ford

[11] Patent Number: 5,123,471

[45] Date of Patent: Jun. 23, 1992

[54] ADJUSTABLE VERTICAL VANE HANGER

[75] Inventor: Alan A. Ford, Sturgis, Mich.

[73] Assignee: Cooper Industries, Inc., Houston, Tex.

[21] Appl. No.: 591,155

[22] Filed: Oct. 1, 1990

[51] Int. Cl.[5] ..... E06B 9/30

[52] U.S. Cl. ..... 160/168.1; 160/236

[58] Field of Search ..... 160/178.1, 168.1, 176.1, 160/900, 236, 172

[56] References Cited

U.S. PATENT DOCUMENTS

| | | | |
|---|---|---|---|
| 2,587,859 | 3/1952 | King | 160/172 |
| 2,625,219 | 1/1953 | Peck | 160/900 X |
| 2,848,045 | 8/1958 | Bennett | 160/172 |
| 2,975,831 | 3/1961 | Taylor et al. | 160/172 X |
| 3,028,910 | 4/1962 | Bopp et al. | 160/172 X |
| 3,280,891 | 10/1966 | Eldredge et al. | 160/172 |
| 4,115,898 | 9/1978 | Frentzel | 160/900 X |
| 4,262,728 | 4/1981 | Debs | 160/172 X |
| 4,356,855 | 11/1982 | Holzer | 160/178.1 |
| 4,648,436 | 3/1987 | Oskam | 160/178.1 X |
| 5,012,552 | 5/1991 | Wulf | 160/168.1 X |

FOREIGN PATENT DOCUMENTS

| | | | |
|---|---|---|---|
| 7804423 | 10/1979 | Netherlands | 160/168.1 |
| 2140490 | 11/1984 | United Kingdom | 160/236 |

*Primary Examiner*—David M. Purol

*Attorney, Agent, or Firm*—Eddie E. Scott; William B. Patterson; Alan R. Thiele

[57] ABSTRACT

An adjustable hanger is slightly wider than the vertical vane and includes a horizontal slot through which the vane is pulled as it is installed in the hanger. To shorten the length of the vane between the hanger and the floor, additional vane material is pulled through the slot. The excess material that has been pulled through the slot hangs down on the opposite side of the vane and is invisible from the front of the blind. Each vane has its own adjustable hanger and can be adjusted individually.

3 Claims, 2 Drawing Sheets

ADJUSTABLE VERTICAL VANE HANGER

BACKGROUND OF INVENTION

The present invention relates to vertical blinds; more particularly the present invention relates to a device to support a vertical vane in a window blind and also allow for vertical adjustment of the vane between the vane hanger and the floor.

Vertical vane window blinds are well known in the art as an alternative to horizontal blinds. Typically, vertical blinds are made from strips of material of the same length and width and are hung side by side from a support structure at the top of a window. The entire group of vanes can usually be moved laterally and in addition, the vanes can be rotated around a vertical axis to allow varying amounts of light to pass through.

In fabric vane window blinds, the individual vanes are cut to an exact length depending on the application and the distance between the hanger and the floor at the place of use. Currently, the vanes are sewn to a hanger after they are cut to length. Cutting the vanes to length requires exacting measurements to be taken as well as additional time. Because of miscalculations, individual vanes or entire sets of vanes are sometimes unusable because they have been cut to the wrong length. Vertical blinds made for a one location are usually unusable at a different location because the length of the vanes can not be changed. Also, the end user has no way to make adjustments to the vanes length to suit changing styles and taste.

There is a need therefore, for a vertical vane hanger that allows the vanes to be adjusted between the hanger and the floor by the end user.

SUMMARY OF THE INVENTION

The present invention relates to an adjustable hanger for use with a vertical blind that allows the height of the individual flexible vanes to be adjusted between the vane hanger and the floor. The hanger is slightly wider than the vertical vane and includes a horizontal slot through which the vane is pulled as it is installed in the hanger. To shorten the length of the vane, additional vane material is pulled through the slot. The excess material that has been pulled through the slot hangs down on the opposite side of the vane and is invisible from the front of the blind. Each vane has its own adjustable hanger and can be adjusted individually.

BRIEF DESCRIPTION OF THE FIGURES

A better understanding of the present invention may be had by reference to the following figures.

DESCRIPTION OF A PREFERRED EMBODIMENT

Figure 2:
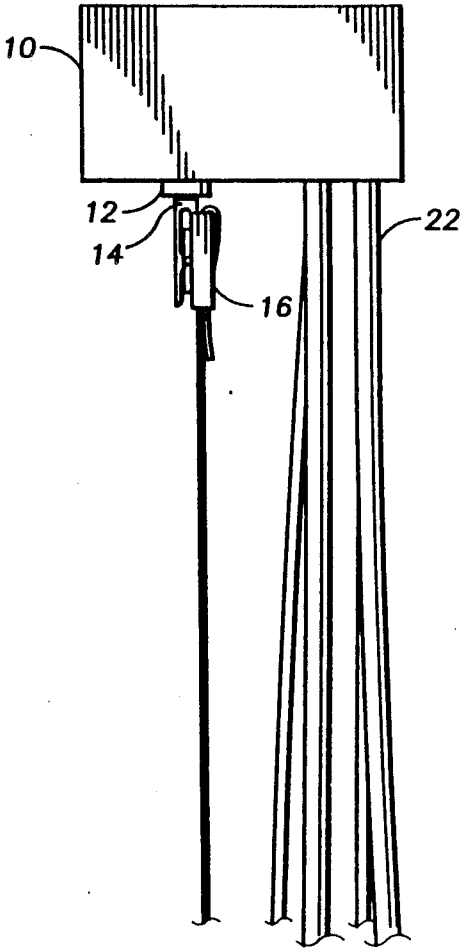
FIG. 2 is a side view of a window blind assembly including the adjustable vane hanger.
Figure 1:
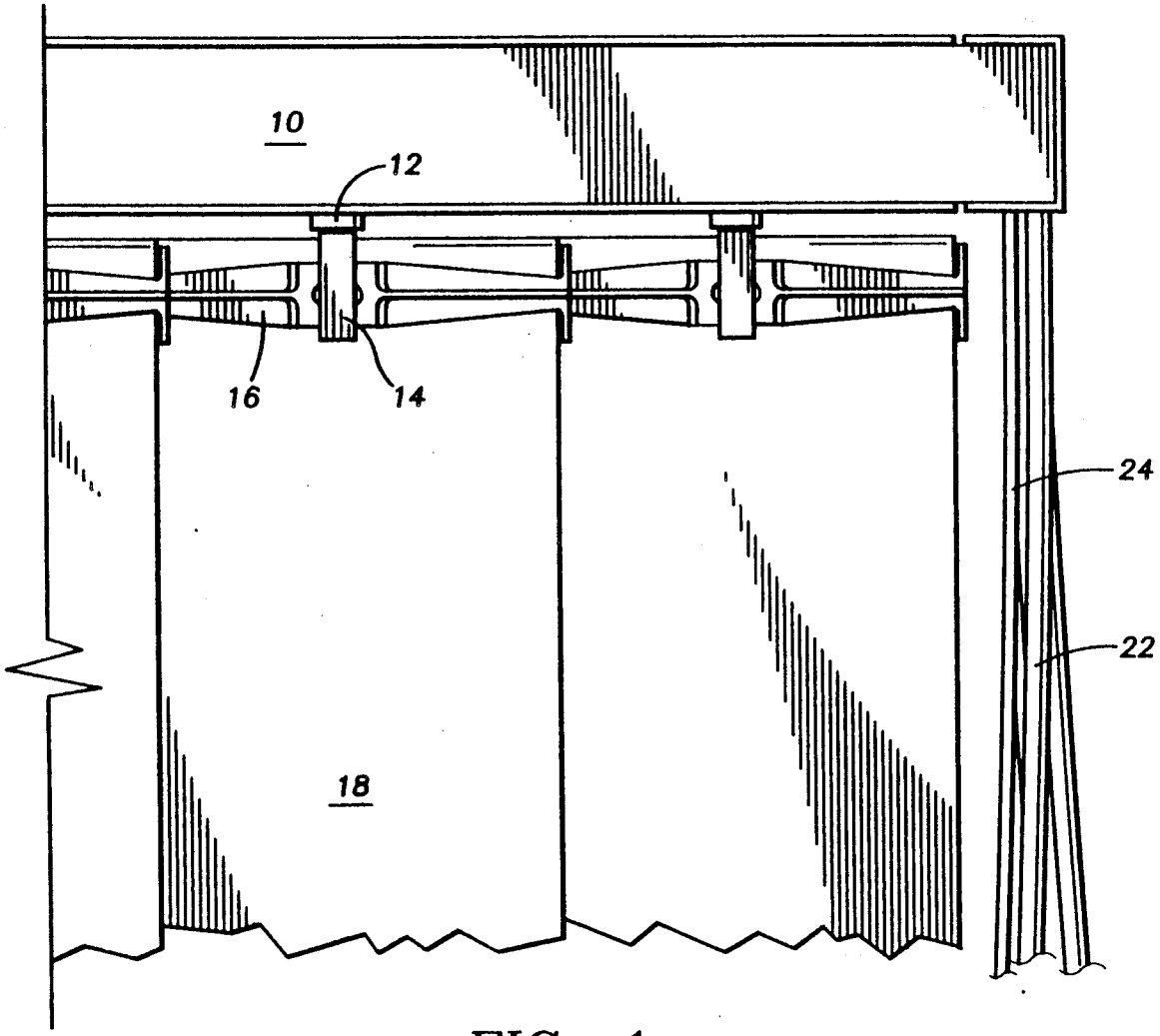
FIG. 1 is a view of a window blind assembly depicting two vanes and also including the adjustable vane hanger that is the subject of the present invention.

The vertical window blind assemblies to which the present invention relates can best be understood by reference to FIGS. 1 and 2, both of which show the vanes in a closed position. A rod 10 houses a master carrier with sliding bracket holders 12 for each vane. Each sliding bracket holder 12 holds one bracket 14 and each bracket attaches to one vane hanger 16. The vanes 18 are attached to vane hangers 16. The movement of the vanes is controlled by cords 22 and 24 at one end of the rod. The resulting assembly comprises a set of vertical vanes which can be individually tilted and will also traverse as a group to one side of the rod.

Figure 3:
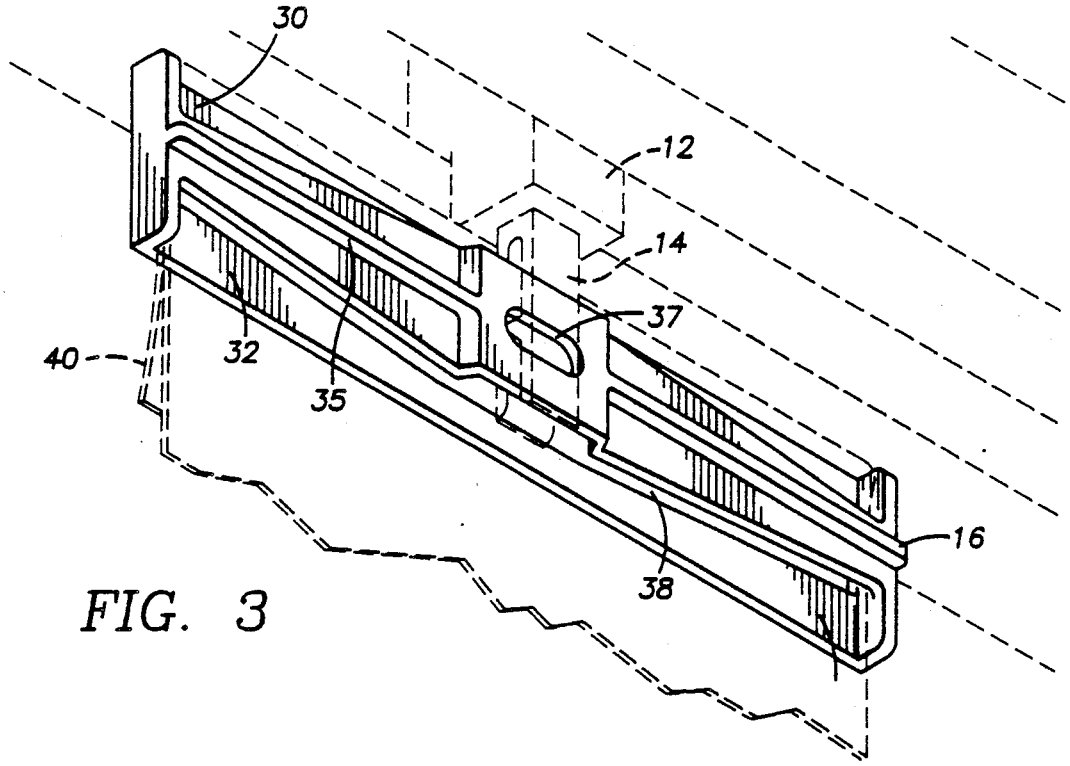
FIG. 3 is a perspective view, partially in section, of a window blind assembly including the adjustable vane hanger.
Figure 4:
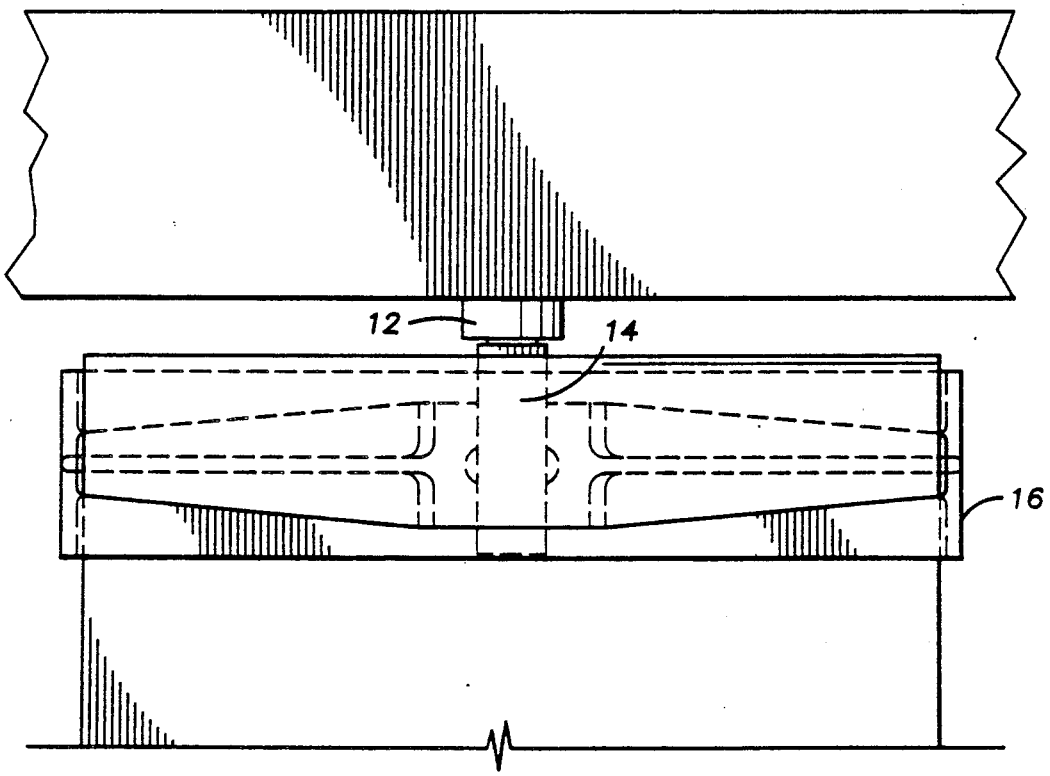
FIG. 4 is a front view, partially in section, of a window blind assembly including the adjustable vane hanger.

The adjustable vanes hangers that are the subject of the present invention can best be understood by reference to FIGS. 3 and 4. Vane hanger 16 is designed to allow the end user of the window blind assembly to install the vanes at any height. The hanger consists of two lower cross members 30, 32 and one upper cross member 35. A narrow slot 38 is formed between the upper and lower cross members and runs the width of hanger 16.

To install the vane in the hanger, the user inserts the end of the fabric vane 18 in the hanger from the bottom, pulling the vane through slot 38 between cross members 30, 32 and 35. Once the vane has been pulled through slot 38, the hanger is attached to bracket 14 which snaps into hole 37 in vane hanger 16. The vane length is then adjusted and excess material 40 hangs to the rear of the hanger where it will not be visible from the front of the window blind. Because it allows each vane to be adjusted separately by the end user, the present invention overcomes the problems associated with vertical vanes of a precut length.

While the preferred embodiment utilizes an adjustable hanger with three cross members, it will be understood that the adjustable vane hanger of the present invention could utilize any number of cross members and still be in the purview of the invention. For example, the hanger could be constructed with only two horizontal cross members and still allow for the insertion of vane material through the slot created by the two cross members. In addition, the cross members could be rollers. The hanger body described herein can be constructed of plastic, metal or any other material that can be formed. In addition, the hanger can be colored to match any color vane material.

While the vane material is fabric in the preferred embodiment, it is to be understood that the present invention can be used with vanes of any material that is flexible enough fit through a slot and hang from the other side of the hanger. For example, vanes made of thin plastic or other synthetic material could provide the flexibility needed to be used with the adjustable hanger of the present invention. Also, the rubber or plastic backing commonly applied to the back of fabric vanes provides sufficient flexibility to be used with the present invention.

It will be understood that the following claims are intended to cover all of the specific features of the invention herein described.

I claim:

1. A one-piece adjustable vertical vane hanger for a window blind, said hanger comprising:

means for attachment to a hanging bracket;

a hanger body consisting of two substantially vertical end pieces separated by a central cross member in a first plane and two outer cross members in a second plane parallel to said first plane, said cross members forming a slot-shaped aperture whereby a vertical vane is frictionally held in said hanger body.

2. A vane and hanger assembly for a vertical window blind, said assembly comprising:

a flexible vertical vane;

a vane hanger consisting of a hanger body, said hanger body consisting of two substantially vertical endpieces separated by a central cross member in a first plane and two outer cross members in a second plane parallel to said first plane, said cross members forming a slot-shaped aperture whereby said vertical vane is frictionally held in said hanger body.

3. A vertical window blind assembly comprising:

a support rod;

a plurality of movable brackets in said support rod;

a means for sliding said brackets along said support rod;

a plurality of flexible, substantially vertical vanes; and an adjustable vertical vane hanger, said hanger including: a hanger body consisting of two substantially vertical endpieces separated by a central cross member in a first plane and two outer cross members in a second plane parallel to said first plane, said cross members forming a slot-shaped aperture whereby said vertical vane is frictionally held in said hanger body.

* * * * *